US011155396B2

(12) United States Patent
Nevo et al.

(10) Patent No.: US 11,155,396 B2
(45) Date of Patent: Oct. 26, 2021

(54) MULTIPURPOSE INFLATABLE PACKAGE

(71) Applicant: Airguard Ltd., Moshav Bazra (IL)

(72) Inventors: Shlomo Nevo, Tel-Aviv (IL); Moshe Malik, Kfar-Yona (IL); Iris Gallant, Tel-Aviv (IL)

(73) Assignee: Airguard Ltd., Ein HaMifratz (IL)

( * ) Notice: Subject to any disclaimer, the term of this patent is extended or adjusted under 35 U.S.C. 154(b) by 0 days.

(21) Appl. No.: 16/305,436

(22) PCT Filed: Jun. 8, 2017

(86) PCT No.: PCT/IL2017/050644

§ 371 (c)(1),
(2) Date: Nov. 29, 2018

(87) PCT Pub. No.: WO2017/212493

PCT Pub. Date: Dec. 14, 2017

(65) Prior Publication Data

US 2019/0225403 A1 Jul. 25, 2019

Related U.S. Application Data

(60) Provisional application No. 62/347,147, filed on Jun. 8, 2016.

(51) Int. Cl.
*B65D 81/05* (2006.01)
*B65B 55/20* (2006.01)
(Continued)

(52) U.S. Cl.
CPC ..... *B65D 81/052* (2013.01); *B65B 5/04* (2013.01); *B65B 55/20* (2013.01); *B65D 33/00* (2013.01)

(58) Field of Classification Search
CPC ..... B65D 81/052; B65D 33/00; B65B 5/04; B65B 55/20
(Continued)

(56) References Cited

U.S. PATENT DOCUMENTS 5,348,157 A * 9/1994 Pozzo ..... B65D 81/052 206/522
5,588,533 A * 12/1996 Farison ..... B65D 81/052 206/522
(Continued)

FOREIGN PATENT DOCUMENTS

WO WO 02/055293 7/2002
WO WO 2013/088372 6/2013
(Continued)

OTHER PUBLICATIONS

International Preliminary Report on Patentability dated Dec. 20, 2018 From the International Bureau of WIPO Re. Application No. PCT/IL2017/050644. (6 Pages).
(Continued)

*Primary Examiner* — Chun Hoi Cheung

(57) ABSTRACT

A precursor for an inflated package comprises an article-receiving pocket for insertion of the article into the pocket. Inflatable panels connected around the article receiving pocket are foldably connected to the article receiving pocket. The precursor is inflated and the article is placed therein before or after inflation. The inflated package is then placed in a box. The panels cushion the pocket part from the sides, wall and floor of the box.

23 Claims, 10 Drawing Sheets

(51) Int. Cl.
*B65B 5/04* (2006.01)
*B65D 33/00* (2006.01)

(58) Field of Classification Search
USPC ..... 206/522, 583
See application file for complete search history.

(56) References Cited

U.S. PATENT DOCUMENTS 5,762,197 A * 6/1998 Farison ..... B65D 81/052 206/522
5,769,231 A * 6/1998 Batsford ..... B65D 81/052 206/522
6,195,966 B1 3/2001 Shomron et al.
6,223,901 B1 * 5/2001 Lofgren ..... B65D 81/075 206/495
6,244,440 B1 * 6/2001 Tschantz ..... B65D 81/052 206/521
6,244,441 B1 * 6/2001 Ahlgren ..... B32B 27/322 206/522
6,398,029 B1 * 6/2002 Farison ..... B65D 81/052 206/522
6,513,974 B2 * 2/2003 Malone ..... B65D 81/052 206/522
8,251,215 B2 * 8/2012 Lin ..... B65D 81/03 206/522
8,251,216 B1 * 8/2012 Liao ..... B65D 81/052 206/522
8,728,595 B1 * 5/2014 Liao ..... B65D 81/052 206/522
8,936,156 B1 * 1/2015 Tschantz ..... B65D 81/052 206/522
10,040,618 B2 * 8/2018 Nevo ..... B65B 51/10
2005/0006271 A1 * 1/2005 Nakagawa ..... B65D 81/052 206/521
2006/0144745 A1 * 7/2006 Abe ..... B65D 81/052 206/522
2007/0017844 A1 * 1/2007 Komatsu ..... B65D 81/052 206/521
2007/0051655 A1 * 3/2007 Yoshifusa ..... B65D 81/052 206/522
2007/0051656 A1 * 3/2007 Hsin ..... B65D 81/052 206/522
2007/0095711 A1 * 5/2007 Thompson ..... B65D 5/5088 206/522
2008/0159659 A1 * 7/2008 Liao ..... B65D 81/052 383/3
2008/0197041 A1 * 8/2008 Jian ..... B65D 81/052 206/522
2009/0032429 A1 * 2/2009 Morris ..... B65D 75/08 206/522
2009/0173649 A1 7/2009 Liao et al.
2010/0032336 A1 * 2/2010 Yokoyama ..... B65D 81/052 206/522
2011/0240515 A1 * 10/2011 Ridgeway ..... B65D 5/5028 206/583
2014/0183097 A1 * 7/2014 LeRoy ..... B65D 75/305 206/583
2014/0224699 A1 * 8/2014 Smith ..... B65B 5/06 206/522
2014/0328551 A1 * 11/2014 Nevo ..... B65B 1/04 383/3
2016/0122112 A1 5/2016 Nevo et al.

FOREIGN PATENT DOCUMENTS

WO WO 2015/192707 12/2015
WO WO 2017/212493 12/2017

OTHER PUBLICATIONS

International Search Report and the Written Opinion dated Aug. 28, 2017 From the International Searching Authority Re. Application No. PCT/IL2017/050644.

* cited by examiner

MULTIPURPOSE INFLATABLE PACKAGE

RELATED APPLICATIONS

This application is a National Phase of PCT Patent Application No. PCT/IL2017/050644 having International filing date of Jun. 8, 2017, which claims the benefit of priority under 35 USC § 119(e) of U.S. Provisional Patent Application No. 62/347,147 filed on Jun. 8, 2016. The contents of the above applications are all incorporated by reference as if fully set forth herein in their entirety.

FIELD AND BACKGROUND OF THE INVENTION

The present invention, in some embodiments thereof, relates to a multipurpose inflatable package and, more particularly, but not exclusively, to a package for holding relatively fragile devices such as assembled and partly assembled printed circuit boards, and electronic devices such as smart phones, laptops and the like.

Inflatable packages are one option available to the dispatcher sending orders via courier or through the post. Other options include rigid blocks of polyurethane, polyethylene and polystyrene foam, and foam beads.

Inflated packaging materials have some known advantages. For example, such packaging materials can be stored flat or on rolls and occupy little space before inflation. Likewise, the inflated portions can be deflated after use, for example, by cutting or puncturing, and again occupy little space.

Inflated packages are generally recyclable, and are advantageous in countries and localities that impose strict environmental rules on disposal of packaging materials. After being used, foam materials are hard to get rid of since they are bulky.

Used deflated packages take up only 2% volume of comparable foam packages.

In one example of the existing art, the automatic inflation system used inflates the packages to atmospheric pressure so that the packaging is insufficient when high levels of protection are needed which require the drop test standard.

IL2004/050403 teaches an inflator device which is able to inflate packaging at higher than atmospheric pressure to meet and exceed the drop standard test.

IB2012/057244 describes an inflatable package having six panels which wrap around a product to be protected, and in effect form a cushioned box that protects the product on all sides.

As shown in FIGS. 4, 5 and 6 of that document, the panels are specifically contoured to meet the shape demands of the product and thus lack generality.

Although the product is well secured, any given inflatable package is limited, if not to a particular product then to a particular size and form factor.

SUMMARY OF THE INVENTION

The present embodiments seek to separate the storage function from the protection function within a single inflatable package and thus provide an inflatable package which is suitable for any fragile product within a reasonable size and range of form factors. A specific size of inflatable package may thus be suitable for a wide range of products and a range of different sizes may be provided.

According to an aspect of some embodiments of the present invention there is provided a precursor for an inflated package comprising:

a first article-receiving pocket for insertion of the article therein; and a plurality of inflatable panels connected around the article receiving pocket and connected to the article receiving pocket, at least some of the inflatable panels being foldable.

In an embodiment, there is one of the plurality of inflatable panels on each one of four lateral sides of the pocket.

In an embodiment, the plurality of inflatable panels are foldable to extend above or below a plane of the article-receiving pocket.

In an embodiment, each panel comprises first and second inflatable cushions, the first cushion running along an adjacent lateral side of the pocket and a second cushion parallel to the first cushion and connected via a folding region to the first cushion.

The precursor may be inflated and placed in a box such that the article-receiving pocket extends laterally across the box and wherein two of the inflatable panels are folded below the article-receiving pocket to support the article-receiving pocket against two walls of the box from below and two of the inflatable panels are folded above the article-receiving pocket to support the article receiving pocket against two other walls of the box from above.

The precursor may comprise first fold lines forming hinge areas between the article receiving area and adjacent panels, and/or second fold lines forming hinge areas between first and second cushions of respective panels.

The precursor may comprise connecting passages between the panels and an inflation port.

The panels may be self-folding after inflation.

The panels may comprise one or more foldable areas; and one or more inflatable areas.

The precursors may be stored on rolls or flat sheets before inflation, and may additionally or alternatively include an inflation manifold configured to facilitate manual or machine inflation.

In an embodiment, two of the inflatable panels are oriented longitudinally relative to a first line of symmetry and two others of the inflatable panels are oriented transversely relative to the first line of symmetry.

In an embodiment, the article-receiving pocket is defined by a non-inflatable area having upper and lower sheet walls and an insertion slot for inserting an article into the pocket between the upper and lower sheet walls.

In an embodiment, four of the first inflatable cushions surround the article-receiving pocket.

In an embodiment, the second inflatable cushions are respectively connected to each of the surrounding first inflatable cushions via a foldable panel part, the second inflatable cushions being connected via the first inflatable cushions to an inflation port.

In an embodiment, at least some of the inflatable areas not directly connected to an inflation port are connected in parallel to an upstream inflatable area by a connecting passage.

In an embodiment, hinges for folding comprise uninflated regions defined between seam lines.

In an embodiment, the article-receiving pocket is defined by a non-inflatable area within which articles are received between upper and lower surfaces within margins of surrounding inflatable areas.

In an embodiment, the panel areas include shaping areas to help ensure folding of the panels upon inflation.

In an embodiment, the packaged article is within the article-receiving area before the precursor has been inflated. Alternatively, the packaged article is not placed within the article-receiving area until after the precursor has been inflated.

The precursor may be formed from polymer sheeting comprised of two or sheets of polymer film or an extruded sleeve having bonds in selected areas to define margins of inflated and un-inflated areas and inflation passages.

The present embodiments extend both to the precursor and to the inflated package formed by inflating the precursor.

According to a second aspect of the present invention there is provided a method of protecting a fragile product for transport, comprising:

providing a package precursor having a pocket surrounded by at least four inflatable panels;

inserting the fragile product into the pocket;

inflating the package precursor to form an inflated package;

folding two of the inflated panels upwards and two of the inflated panels downwards; and placing the inflated package in a box.

According to a third aspect of the present invention there is provided a method of protecting a fragile product for transport, comprising:

providing two package precursors, each precursor comprising a pocket area surrounded by at least four inflatable panels;

inflating the package precursors to form an inflated package;

inserting the fragile product between the pocket areas, either before or after the inflating;

folding two of the inflated panels upwards and two of the inflated panels downwards; and placing the inflated package in a box.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control.

In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
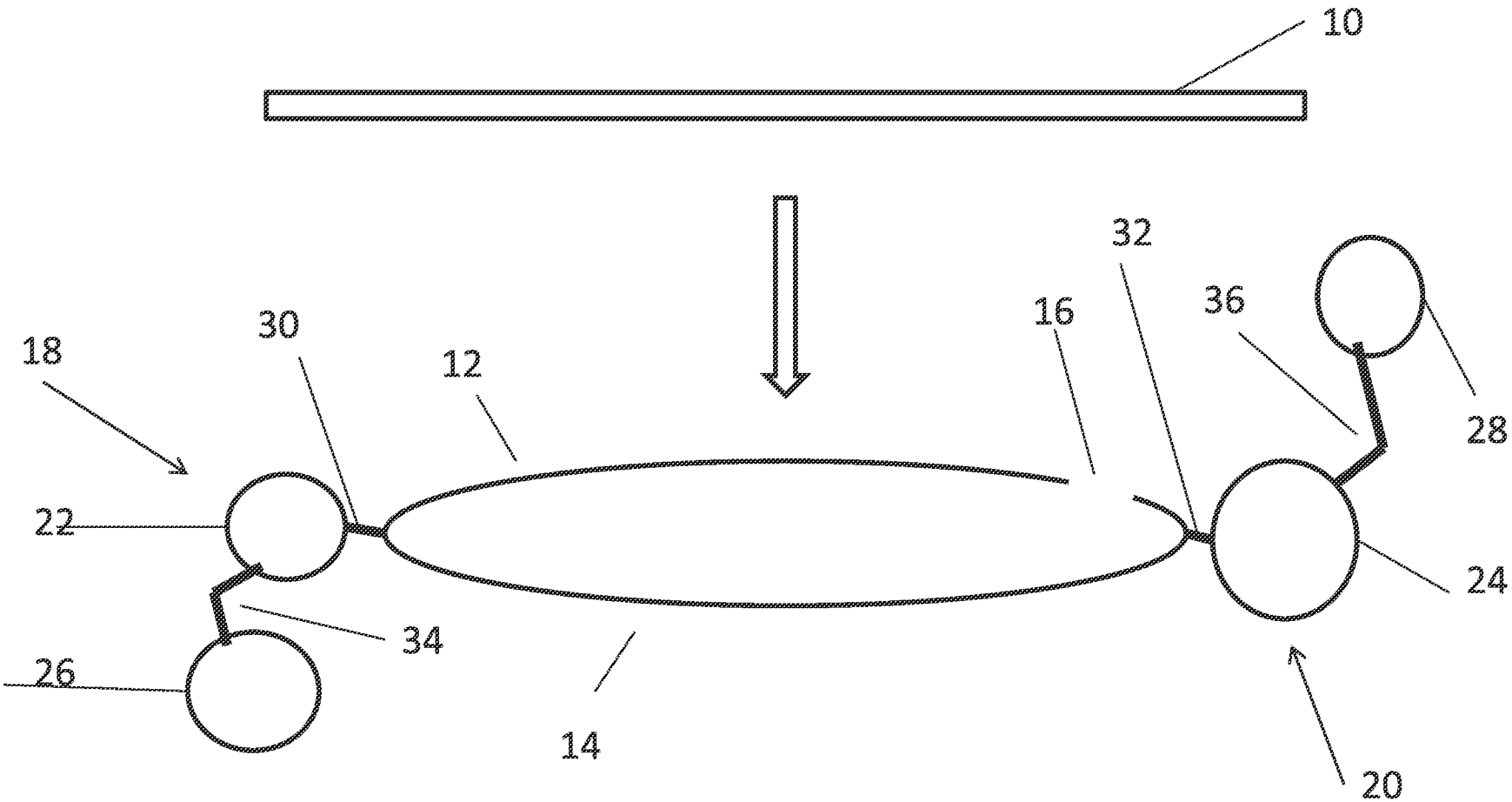
FIG. 1 is a simplified diagram showing a bag precursor according to a first embodiment of the present invention.

The present embodiments relate to a multipurpose inflatable package and, more particularly, but not exclusively, to a package for holding relatively flat fragile devices such as assembled and partly assembled printed circuit boards.

A precursor for an inflated package comprises an article-receiving pocket for insertion of a fragile article therein for example prior to inflation, but alternatively after inflation. Inflatable panels are connected around the article receiving pocket and foldably connected to the article receiving pocket. The article is placed in the pocket and the precursor is inflated into a bag so that when the inflated bag is placed in a box, the panels cushion the pocket part from the side walls, top and floor of the box.

There are typically four side panels, one on each of four sides, and each is made of one, two or more inflated cushions or cylinders. One of the cylinders is adjacent to the pocket and wedges the pocket against the adjacent side wall. The other is folded inwards by the side wall and cushions the pocket against the top or floor of the box depending on whether it is folded upwards or downwards. In use, two of the side panels are folded upwards and two of the side panels are folded downwards to cushion the product against both the top and floor of the box.

The use of a pocket means that any article that can fit in the pocket can be protected by the package. The dimensions of the package are defined for the box in which the inflated package is placed and not for the article.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 illustrates a precursor 10 for an inflated package. The precursor is flat so that it can be conveniently provided, say on a stack or a roll, and compactly stored. The precursor is removed from the stack or is unrolled, as appropriate, and is inflated for use. When unrolled, a central pocket section 12 is revealed, having upper 12 and lower 14 walls and an opening 16. An article requiring protection is inserted through opening 16 into the pocket defined by upper and lower walls.

The article may be inserted into the article-receiving pocket prior to inflation of the precursor. Alternatively, as discussed hereinbelow, the article may be inserted after inflation of the precursor.

Inflatable panels 18 and 20 are connected around the article receiving pocket.

As shown, each panel consists of a first inflated cylinder 22, 24 and a second inflated cylinder 26, 28 connected to said article receiving pocket via an un-inflated area 30, 32, which allows the side panels flexibility. The uninflated areas are bounded by seams. The first inflated cylinders thus wedge the inflated package within a box.

Second uninflated areas 34 and 36 allow for folding and lead to second inflated cylinders 26 and 28. Preferably some of the side panels are folded upwards and some of the side panels are folded downwards, so that the second inflated cylinders protect the pocket from the top and bottom of the box. The inflated cylinders between them thus wedge the article receiving pocket safely in the middle of the box, to be cushioned on all four lateral sides and above and below. As FIG. 1 is a cross section, only two side panels are shown, but the pocket is surrounded on all four sides.

Figure 2:
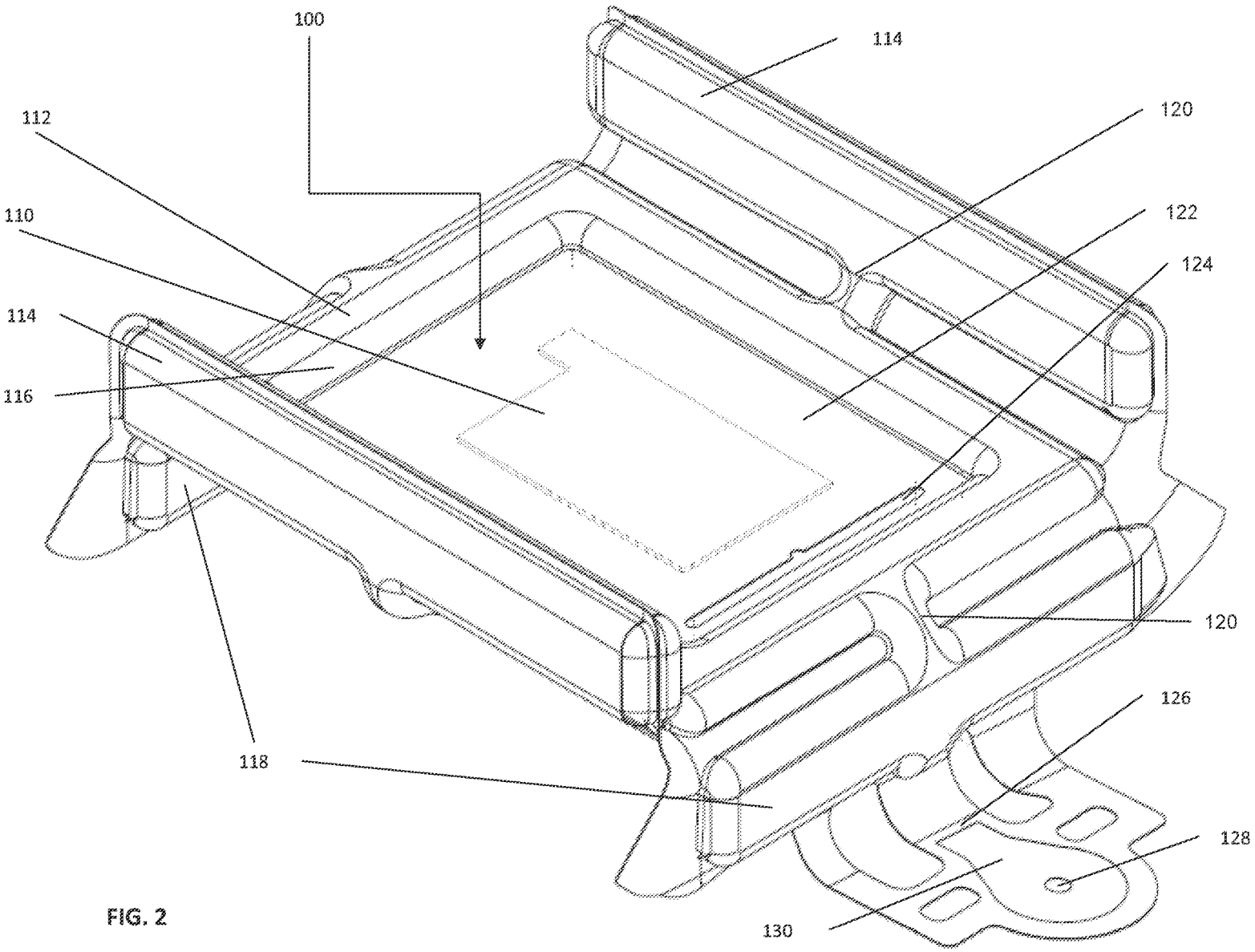
FIG. 2 is a simplified photograph showing the inflated bag containing a product according to embodiments of the present invention.

Reference is now made to FIG. 2, which is a photograph of an inflated bag according to FIG. 1 containing a PCB as an exemplary fragile product, in the pocket.

The inflated package 100 contains a product to be protected 110, here a Printed Circuit Board (PCB). An inflated section 112 contains the first inflated cylinders and extends around all four sides, acting as the base of the folding section. Upper inflated cylinders are shown as 114, and the two oppositely facing cylinders 114 are folded upwards. Heat welded seams and un-inflated areas 116 extend around the pocket, between the pockets and the first inflated cylinders. The remaining inflated cylinders on the two remaining sides, 118, are folded downwards. 120 indicates air passages between two inflated cylinders of the same panel. 122 indicates an un-inflated area in the center, holding the product to be protected in a pocket. 124 indicates a slot to insert the product to be protected into the pocket. 126 indicates a welded seam for sealing the inflated package. 128 indicates an inflating aperture, and area 130 around the inflating aperture becomes un-inflated after sealing and can be cut away as required. The inflation port 130 directs air from an air pressure source to the various inflatable areas of the inflatable panels.

As shown, the inflatable panels are foldable to extend perpendicularly above or below a plane of the article-receiving pocket and thus wedge the package in a suitably sized box. Typically, there are four of the inflatable panels, one on each side of the pocket. As the inflated package is placed in a box, the article-receiving pocket extends laterally across the box with the first inflated cylinders of inflated section 112 wedging the pocket against the lateral walls. Two of the inflatable panels are folded below the article-receiving pocket to support the article-receiving pocket from below and the remaining two inflatable panels are folded above the article-receiving pocket to support the article receiving pocket from above as the second inflated cylinders cushion the package against the upper and lower walls of the box.

The precursor comprises seams and fold lines. There are seams between the article receiving area and the first inflated cylinders which do not serve as folding lines. The seams and the un-inflated areas between the first and second inflated cylinders on the other hand do fold and thus serve as hinges. The hinges are the uninflated regions between seams which fold and the hinges may include passages for inflation fluid. The passages may connect between the panels and the inflation port which allow the cushions or cylinders to be inflated. The hinge areas are not inflated in general but the passages that allow air flow to the inflatable panels on the other side of the seam generally are inflated.

The panels may contain shaping ability to inflate into self-folded shapes after inflation, say to make it more apparent to the user that two of the panels should be folded up and two of the panels should be folded down.

The panels themselves may include inflated cushioning areas, flexible or folding areas and un-inflated connecting areas. Prior to use the precursor may be stored on rolls or flat sheets. The package may be symmetric, so that two of r the inflatable panels are oriented longitudinally relative to a given line of symmetry, and the remaining two panels are oriented transversely relative to the same given line of symmetry.

The article-receiving pocket itself may be defined by a non-inflatable area; and perforations may define a border between portions of the precursor that are inflated when the package is formed and surrounding scrap material, thus making it easier to remove the scrap. Alternatively there are no perforations and the scrap may simply be cut off at a cutting station.

Inflatable areas at least partially surround the article-receiving pocket, and the inflatable areas may be connected in series or in parallel by connecting passages to the inflation port. In general, a single inflation port provides inflation fluid to all inflatable areas in each of the folding panels. Any inflatable areas not directly connected to an inflation port are connected in series or in parallel to an upstream inflatable area by a connecting passage. Fold lines for folding the panels may be formed by hinges comprised of un-inflatable areas defined by marginal bond lines or bonded areas, to provide the stiffness that wedges the package into the box.

The article-receiving pocket may be a non-inflatable area within which articles are received between upper and lower surfaces within margins of surrounding inflatable areas. The panel areas may include welded seams with air passages.

As mentioned, the packaged article may conveniently be placed within the article-receiving area before the precursor has been inflated.

The precursor may be made of two film sheets placed one on top of the other.

Each sheet consists of layers of polymer. In the present embodiments each sheet is made of nine layers but more or fewer layers may also be contemplated by the skilled person. The layers are alternate layers of PE polyethylene and PA polyamide (nylon) and bonding layers that form between PE and PA. Thus a 5-layer film sheet may be denoted PE-PA-PE, three layers of polymer and two bonding layers.

The purpose of the layers is to provide mechanical strength to hold the air pressure and to avoid puncture in a drop test and during shipping, to seal against air leakage and to provide weldability. Other materials with similar properties may be substituted.

The plastic sheets typically come in rolls. So to put one sheet on top of the other in a continuous process, the machine that makes the precursors pulls together sheets from two rolls of identical material at a synchronized speed. An alternative to using two rolls is to use one roll of a single folded sheet or one roll of a sleeve.

The sheets or sleeve walls are then bonded in a heat welding phase in which seams are made. The seams define the inflated and un-inflates areas of the package as well as the air passages.

Alternatively an extruded sleeve may be provided with bonds in selected areas to define margins of inflated and un-inflated areas and inflation passages.

Figure 3:
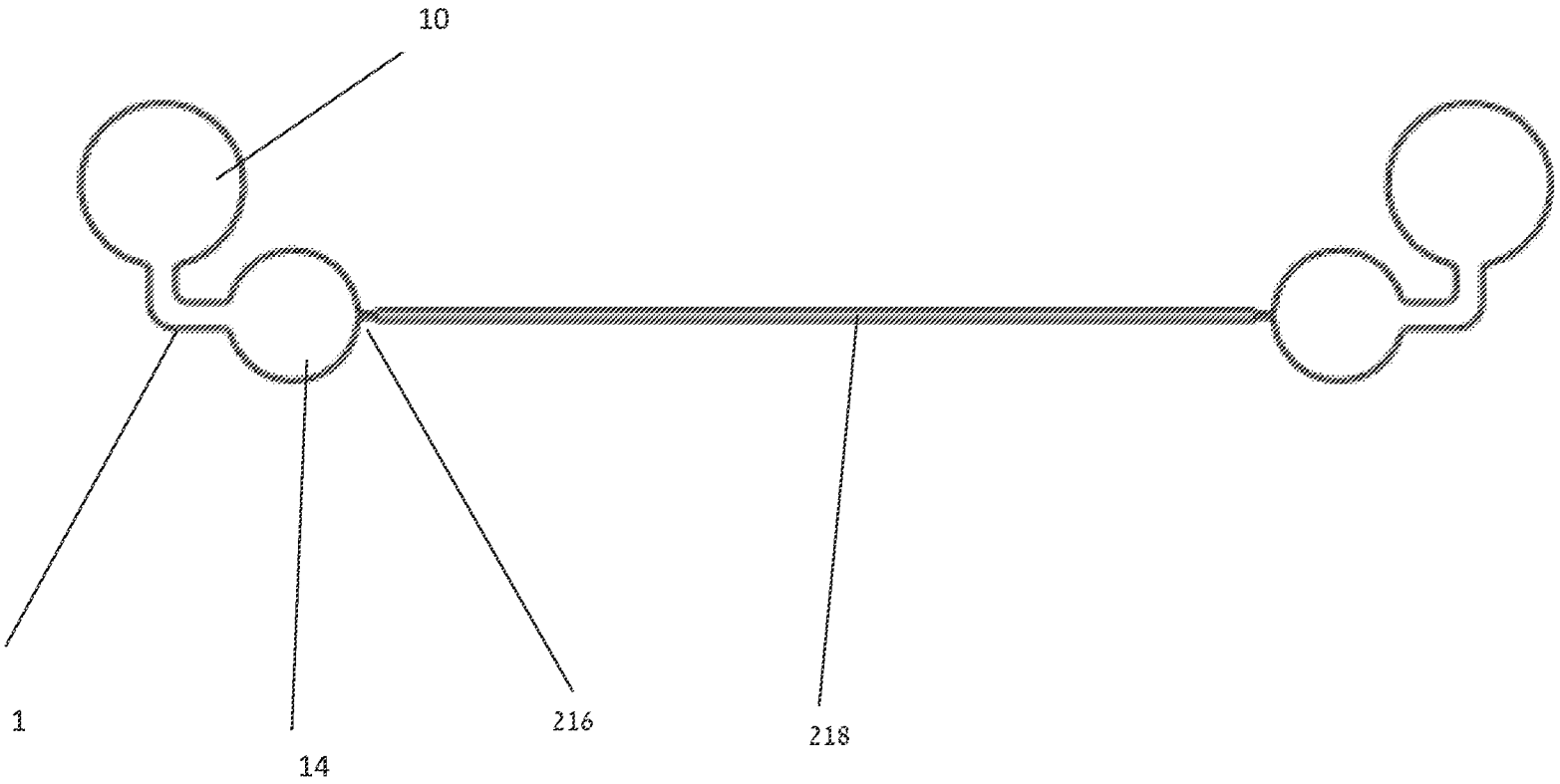
FIG. 3 is a simplified transverse cross section of the bag of the present embodiments when inflated and inserted in a box.

Reference is now made to FIG. 3, which is a simplified diagram showing the package of FIG. 2 in transverse cross section. The cross section extends through air passages 120 of FIG. 2.

Numeral 210 indicates a longitudinal inflated cylinder folded upwards.

Numeral 212 indicates an air passage for providing air to the cylinder 210.

Inflated cylinder 214 encompasses the central pocket area on one side and three more cylinders on the remaining three lateral sides. Heat welded seam 216 seals the central pocket area which in turn is indicated as 218—the un-inflated central area.

The product to be protected is inserted between upper and lower sheets of the central pocket area 218.

Figure 4:
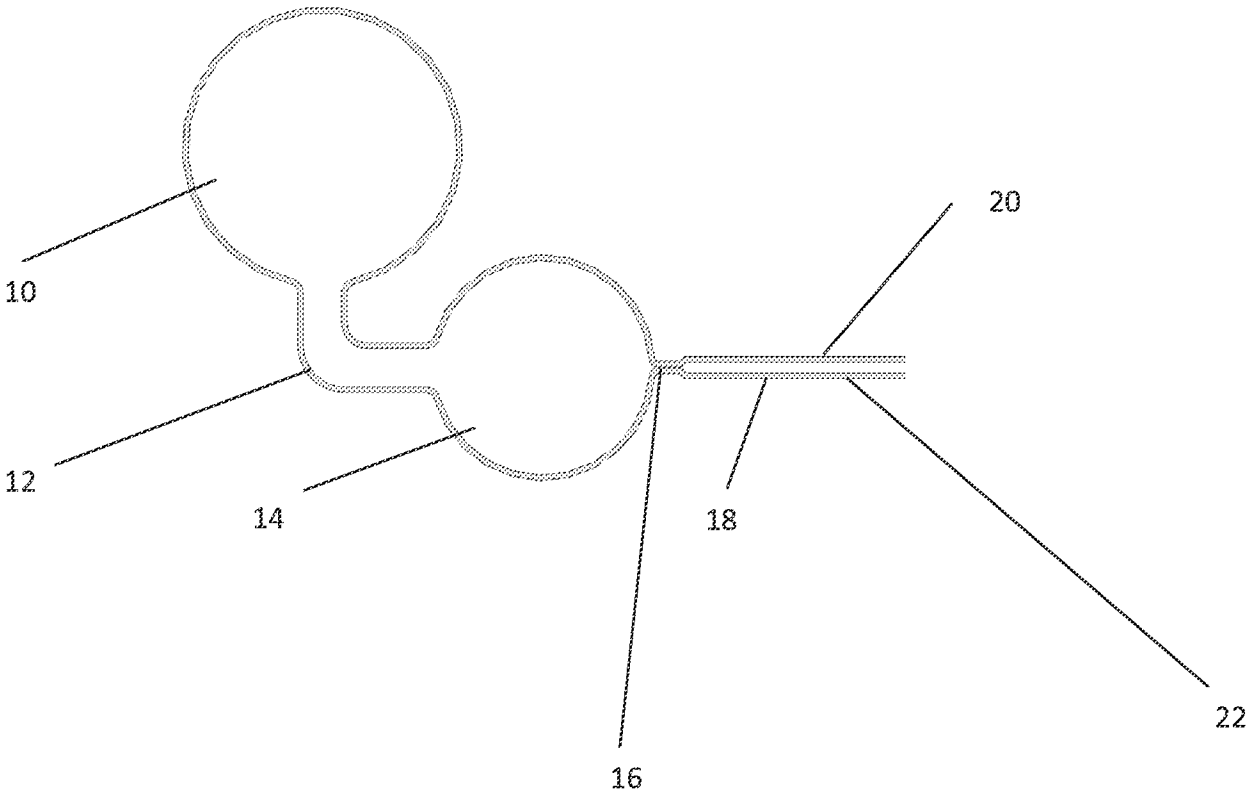
FIG. 4 is an enlargement of part of the cross-section of FIG. 3.

Reference is now made to FIG. 4, which is an enlarged part of the cross-section of FIG. 3. Numeral 310 indicates a longitudinal inflated cylinder turned upwards.

Numeral 312 indicates an air passage. Numeral 314 indicates an inflated cylinder surrounding the central area. Numeral 316 indicates a heat welded seam, which seals the central pocket area 318 which is un-inflated. 320 is the upper sheet of the pocket and 322 is the lower sheet of the pocket.

Figure 5:
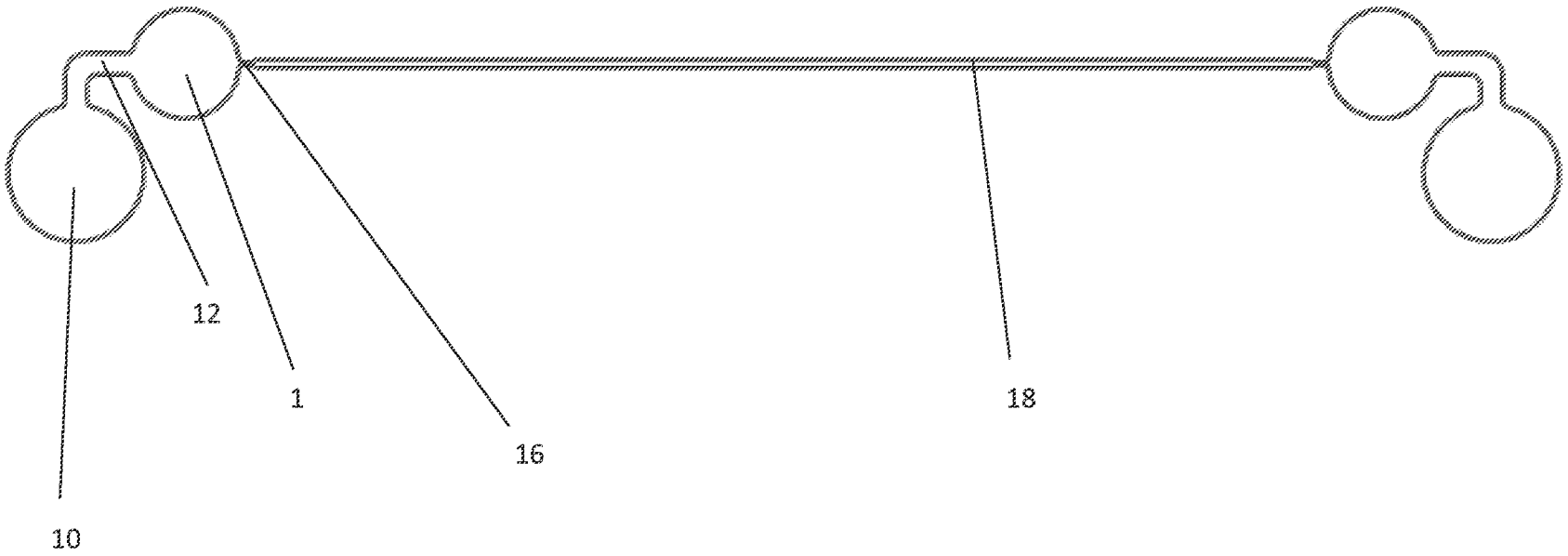
FIG. 5 is a simplified longitudinal cross-section of the bag of the present embodiments when inflated and inserted in a box.

Reference is now made to FIG. 5, which is a simplified diagram showing a longitudinal cross section of the package of FIG. 2. Inflated cylinder 410 is a crosswise inflated section which is turned downwards. Air passage 412 supplies inflation air for section 410. Numeral 414 indicates a cylindrical inflated section surrounding the central pocket area. Numeral 416 indicates a heat welded seam, which seals the central area. Numeral 418 indicates the un-inflated central pocket area itself into which the article is inserted.

Figure 6:
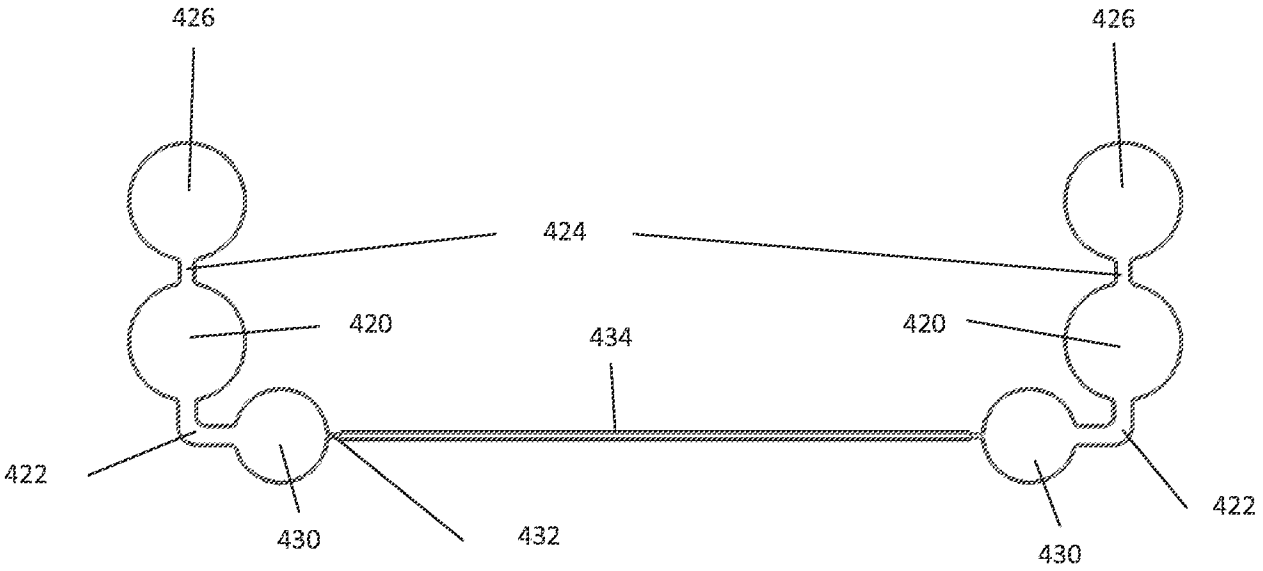
FIG. 6 is a simplified diagram showing a variation of the bag of FIG. 5 with two inflated cushions on each folding segment.

Reference is now made to FIG. 6, which is a variation of the embodiment of FIG. 5 in which there are two inflated cushions or cylinders on the folding part of each panel, making three cushions or cylinders altogether. Numeral 420 indicates a longitudinal inflated cylinder folded upwards. Numeral 422 indicates an air passage for providing air to first cylinder 420. A second air passage 424 provides air to second cylinder 426 of the folded panel. Inflated cylinder 430 encompasses the central pocket area on one side and three more cylinders on the remaining three lateral sides. Heat welded seam 432 seals the central pocket area which in turn is indicated as 434—the un-inflated central area. The product to be protected is inserted between upper and lower sheets of the central pocket area 434.

Figure 7:
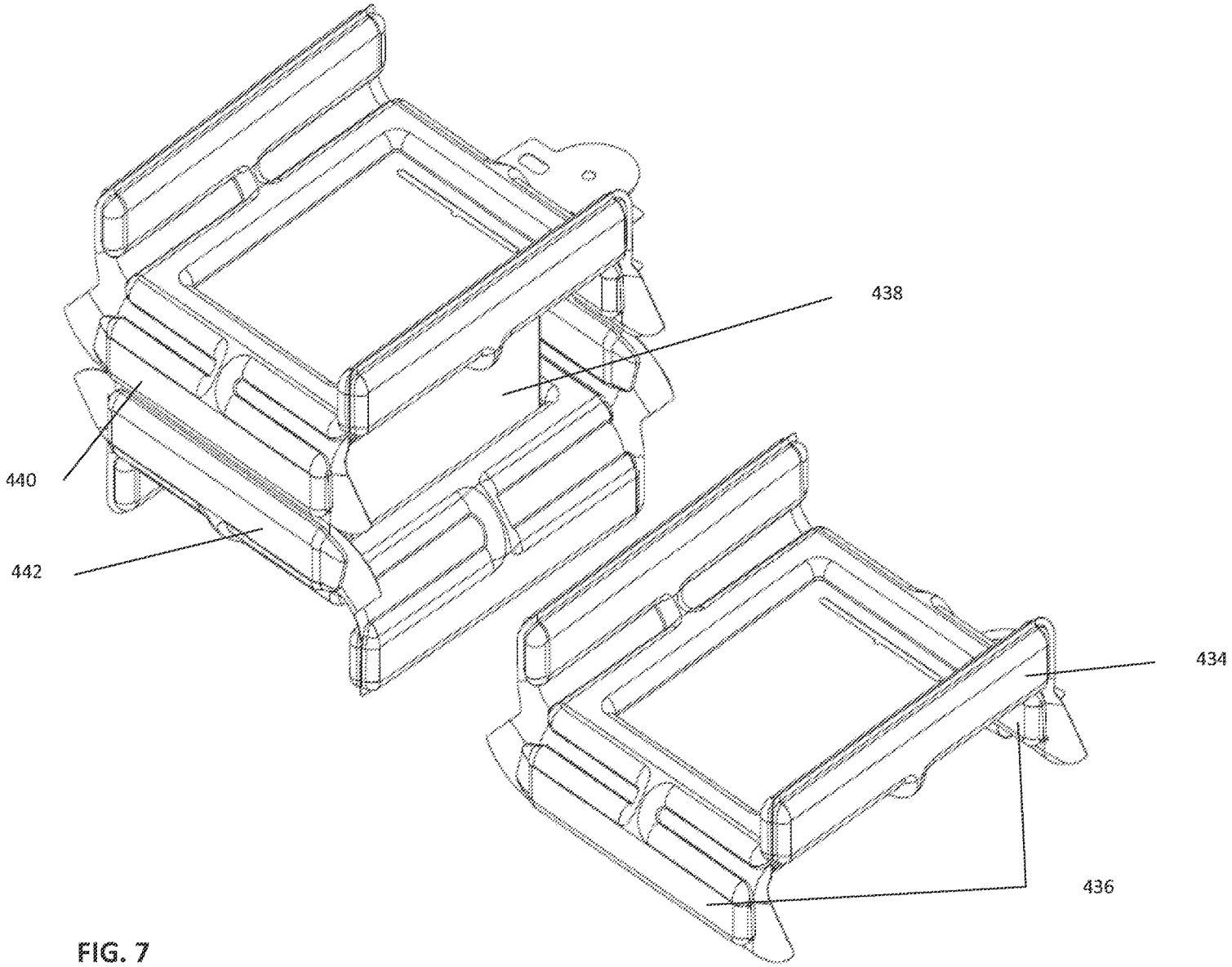
FIG. 7 is a photograph showing three inflated bags of the present embodiments and illustrating how two of them may be used to package a single more bulky product.

Reference is now made to FIG. 7, which is a simplified photograph showing inflated packages according to the present embodiments.

Inflated package 434 rests on downwardly folded panels 436. In the rear, product 438 is placed between two of the packages, 440 and 442.

Figure 9:
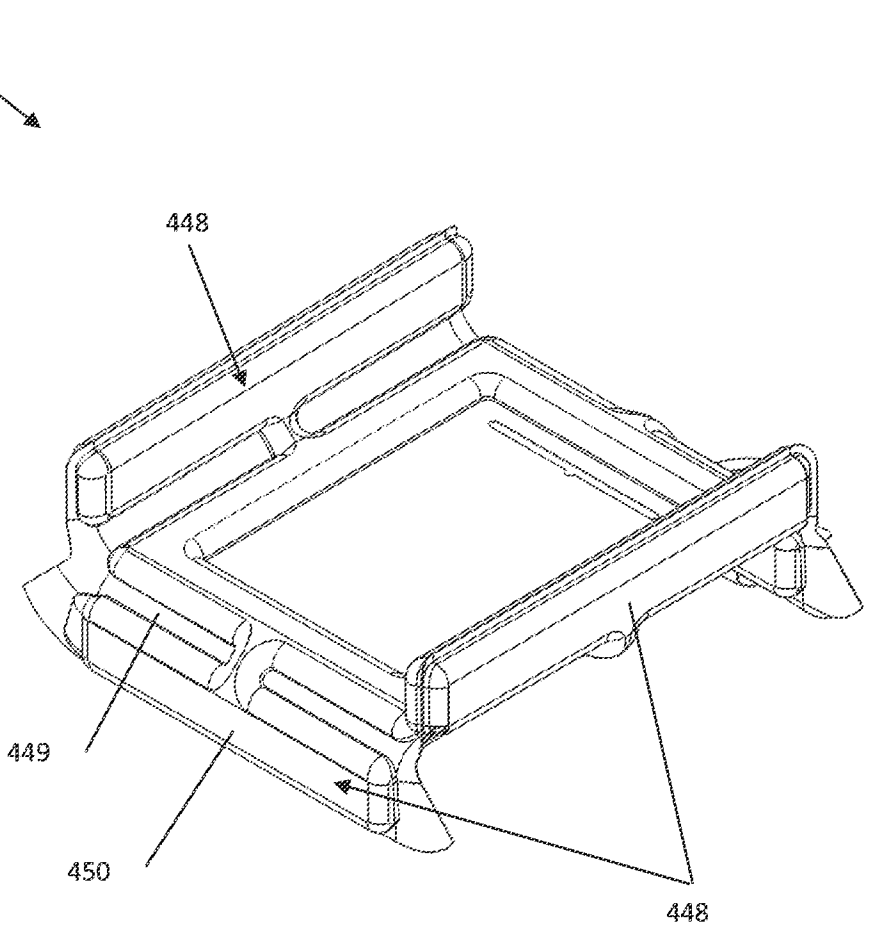
FIGS. 8 and 9 are photographs showing two views of a variation of the present embodiments for products such as laptops.
Figure 8:
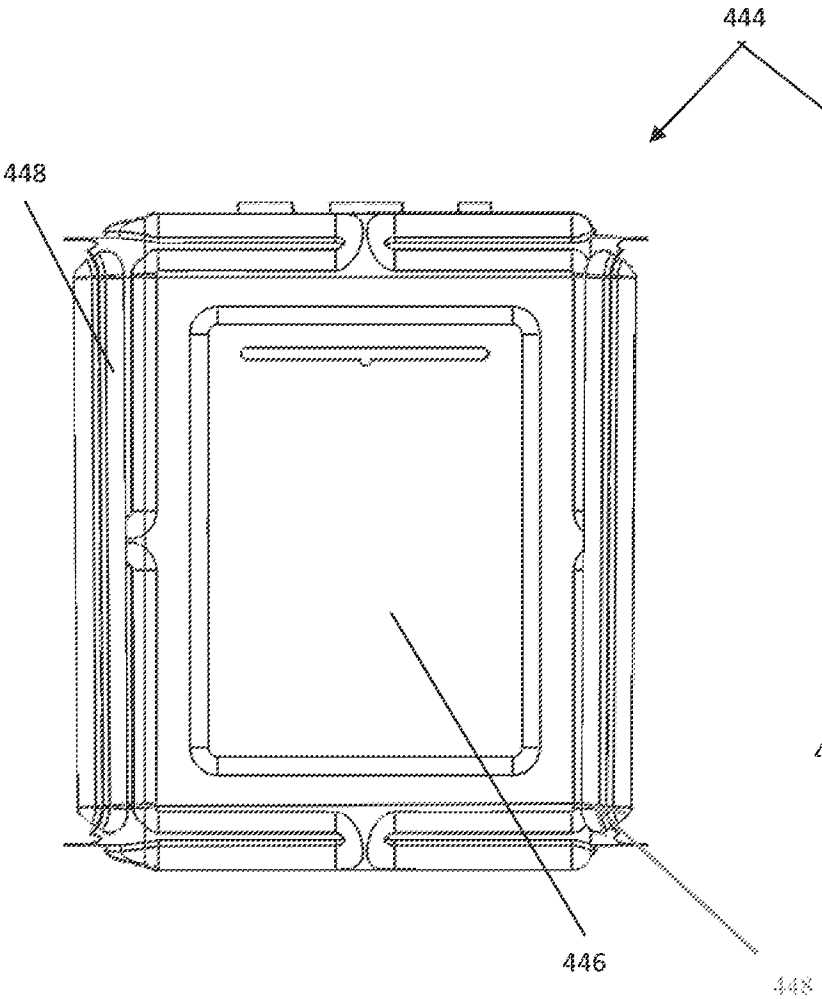
Figure 10:
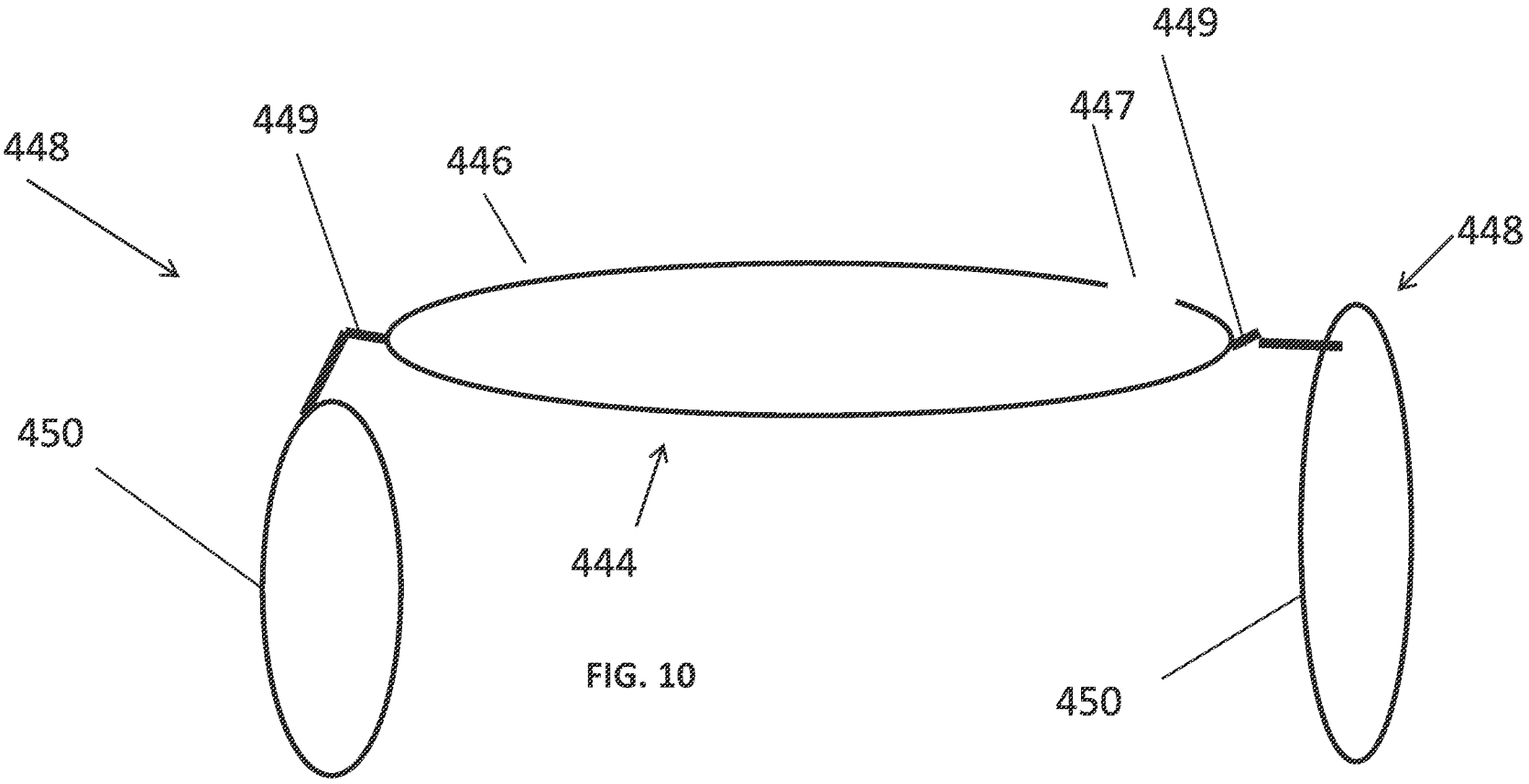
FIG. 10 is a cross-sectional view of the variation of FIGS. 8 and 9.

Reference is now made to FIGS. 8 and 9, which are two views of a variation of the package of the previous embodiments intended for laptops and like shaped products. FIG. 10 is a cross sectional view of the same. The folding panels are the same but the first cushion or cylinder surrounding the non-inflated area is not included.

Package 444 includes central pocket section 446 in which the laptop or like product is placed. Opening 447 allows for the product to be inserted. Four folding sections 448 surround the central pocket section, each section folding independently from its neighbor at uninflated sections 449 which lie beyond the seam and are inflated to form part of the inflated cushions 450. As before, two opposite folding sections are folded in one direction and the remaining two are folded in the other direction, thus providing the protection.

It is to be noted that not all sides need have the same number of cushions. In particular different pairs of oppositely facing folding panels may have different numbers of cushions.

Figure 11:
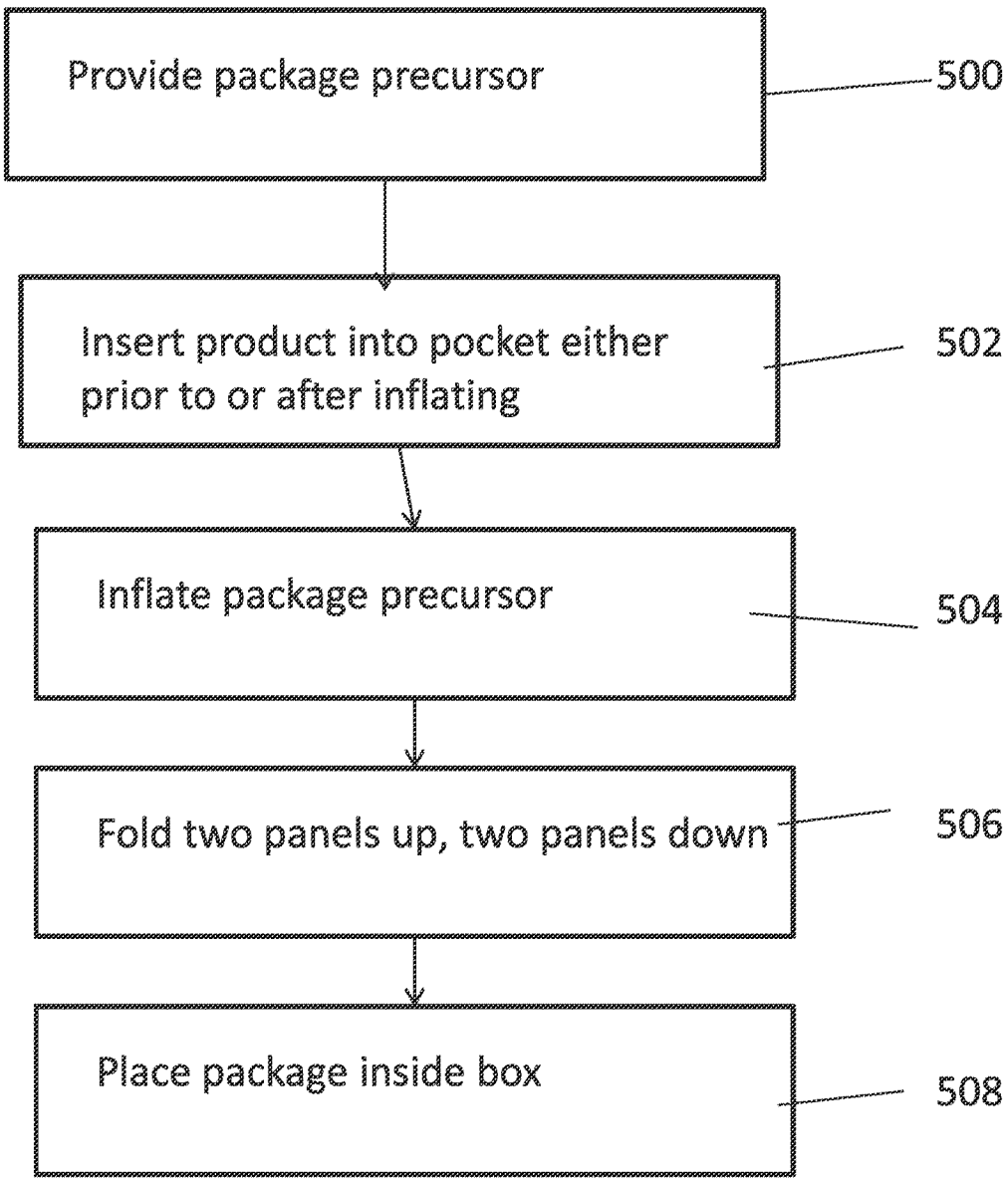
FIG. 11 is a simplified flow chart illustrating the filling and inflating of bags according to embodiments of the present invention.

Reference is now made to FIG. 11, which is a simplified flow chart of use of the package precursor for protecting a product according to an embodiment of the present invention. The task begins 500 by obtaining a package precursor. The sheets that make the un-inflated precursors may come in rolls, but after the heat welding phase of the seams the precursors are separated from the sheets and piled in stacks.

The precursor may have a pocket surrounded by at least four inflatable panels.

The fragile product is then inserted 502 into the pocket of the precursor, either before or after the precursor is inflated. It is possible to inflate the precursor first and then insert the product. After inserting the product, the inflation aperture is then placed in proximity to a stream of air from an inflator device, or in contact with the inflator device itself, and the package with the product inside is inflated 504. The result is an inflated and relatively stiff package with the product held inside in a central pocket.

The side panels on two opposite sides of the package are folded upwards and the side panels on the two remaining opposite sides are folded downwards 506 or vice versa. The package is then placed 508 inside a box in such a way that the product and pocket are suspended in the middle of the box with four inflated cylinders wedged between the central pocket and the side walls, two upwardly folded cylinders distancing the central pocket from the top of the box and two downwardly folded cylinders distancing the central pocket from the floor of the box.

Inflation may involve insertion of a needle, or as alternatives, inflation may be without contact, or via external contact with an inflator, or carried out manually.

The inflator may be the device taught in the present applicant's International patent application No. PCT IL2014/050403, the contents of which are hereby incorporated by reference.

It is expected that during the life of a patent maturing from this application many relevant inflators and packaging materials will be developed and the scopes of the terms used herein are intended to include all such new technologies a priori.

The terms "comprises", "comprising", "includes", "including", "having" and their conjugates mean "including but not limited to".

The term "consisting of" means "including and limited to".

As used herein, the singular form "a", "an" and "the" include plural references unless the context clearly dictates otherwise.

It is appreciated that certain features of the invention, which are, for clarity, described in the context of separate embodiments, may also be provided in combination in a single embodiment, and the above description is to be construed as if this combination were explicitly written. Conversely, various features of the invention, which are, for brevity, described in the context of a single embodiment, may also be provided separately or in any suitable sub combination or as suitable in any other described embodiment of the invention, and the above description is to be construed as if these separate embodiments were explicitly written. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A precursor for an inflated package comprising:

a first article-receiving pocket configured for insertion of said article to be contained inside said article-receiving pocket; and a plurality of inflatable panels connected around said article receiving pocket and connected to said article receiving pocket, at least some of said inflatable panels being foldable to extend above or below a plane of said article-receiving pocket, each panel comprising first and second inflatable cushions respectively, each said first cushion running along an adjacent lateral side of said pocket, each second cushion respectively running parallel to said first cushion and connected via a folding region to said first cushion, ones of said inflatable panels on two respectively facing sides of said precursor being foldable upwards and ones of said inflatable panels on two respectively remaining sides of said precursor being foldable downwards, such that when said precursor is inflated and inserted into a box, with an article placed in said article-receiving pocket, said article and said article-receiving pocket are suspended in a middle of said box with said respective first and second cushions forming four inflated cylinders wedged between said article-receiving pocket and side walls of said box, two of said respective first and second cushions distancing the article-receiving pocket from a top of said box and two others of said respective first and second cushions distancing the article-receiving pocket from a floor of said box.

2. The precursor of claim 1, wherein there is one of said plurality of inflatable panels on each one of four lateral sides of said pocket.

3. The precursor of claim 1, inflated and placed in a box such that said article-receiving pocket extends laterally across said box and wherein two of said inflatable panels are folded below said article-receiving pocket to support said article-receiving pocket against two walls of said box from below and two of said inflatable panels are folded above said article-receiving pocket to support said article receiving pocket against two other walls of said box from above.

4. The precursor of claim 1, comprising first fold lines forming hinge areas between said article receiving area and adjacent panels.

5. The precursor of claim 4, further comprising second fold lines forming hinge areas between respective first and second inflatable cushions of respective panels.

6. The precursor of claim 1, comprising: connecting passages between said panels and an inflation port.

7. The precursor of claim 1, wherein the panels are configured to be self-folding after inflation.

8. The precursor of claim 1, wherein said panels comprise:

one or more foldable areas; and one or more inflatable areas.

9. The precursor of claim 1, stored on rolls or flat sheets before inflation, and comprising an inflation manifold configured to facilitate manual or machine inflation.

10. The precursor according to claim 1, wherein:

two of the inflatable panels are oriented longitudinally relative to a first line of symmetry; and two others of the inflatable panels are oriented transversely relative to said first line of symmetry.

11. The precursor of claim 1, wherein:

said article-receiving pocket is defined by a non-inflatable area having upper and lower sheet walls and an insertion slot for inserting an article into said pocket between said upper and lower sheet walls.

12. The precursor of claim 1, wherein four of said first inflatable cushions surround said article-receiving pocket.

13. The precursor of claim 12, wherein said second inflatable cushions are respectively connected to each of said surrounding first inflatable cushions via a foldable panel part, the second inflatable cushions being connected via said first inflatable cushions to an inflation port.

14. The precursor according to claim 12, wherein at least some of the inflatable areas not directly connected to an inflation port are connected in parallel to an upstream inflatable area by a connecting passage.

15. The precursor according to claim 1, wherein hinges for folding comprise uninflated regions defined between seam lines.

16. The precursor according to claim 1, wherein the article-receiving pocket is defined by a non-inflatable area within which articles are received between upper and lower surfaces within margins of surrounding inflatable areas.

17. The precursor according to claim 1, wherein the panel areas include shaping areas to help ensure folding of the panels upon inflation.

18. The precursor according to claim 1, wherein the packaged article is within the article-receiving area before the precursor has been inflated.

19. The precursor according to claim 1, wherein the packaged article is within the article-receiving area after the precursor has been inflated.

20. The precursor according to claim 1, formed from polymer sheeting comprised of two or sheets of polymer film or an extruded sleeve having bonds in selected areas to define margins of inflated and un-inflated areas and inflation passages.

21. An inflated package formed by inflating the precursor of claim 1.

22. A method of protecting a fragile product for transport, comprising:

providing a package precursor having a pocket surrounded by at least four inflatable panels, each panel attached to said pocket along a length of a respective side of said pocket, each panel having at least one inflatable cushion;

inserting said fragile product into said pocket such that said fragile product is enclosed within said pocket;

inflating said package precursor to form an inflated package;

folding two of said inflated panels upwards and two of said inflated panels downwards; and placing said inflated package in a box; said article and said article-receiving pocket thereby being suspended in a middle of said box with said inflatable cushions forming four inflated cylinders wedged between said article-receiving pocket and side walls of said box, two of said inflatable cushions distancing the article-receiving pocket from a top of said box and two of said inflatable cushions distancing the article-receiving pocket from a floor of said box.

23. A method of protecting a fragile product for transport, comprising:

providing upper and lower package precursors, each precursor respectively comprising a pocket area surrounded by at least four inflatable panels, each panel attached to said pocket along a length of a respective side of said pocket, each panel including at least one inflatable cushion;

inflating said package precursors to form an inflated package;

inserting said fragile product between said two pocket areas, either before or after said inflating, such that said fragile product is enclosed between said two pocket areas;

folding two of said inflated panels upwards to support the article-receiving pocked from above and two of said inflated panels downwards to support the article-receiving pocket from below; and placing said inflated package in a box, such that said article and said article-receiving pocket are suspended in a middle of said box with respective inflatable cushions forming four inflated cylinders wedged between said article-receiving pocket and side walls of said box, two of said inflatable cushions distancing the article-receiving pocket from a top of said box and two of said inflatable cushions distancing the article-receiving pocket from a floor of said box.

* * * * *